United States Patent [19]

Spaller, Jr. et al.

[11] 4,353,492

[45] Oct. 12, 1982

[54] ENDS-DOWN SENSOR DEVICE

[75] Inventors: Albert E. Spaller, Jr., Johnson City; Bruce W. Stockbridge; Thomas D. Meredith, Jr., both of Kingsport, all of Tenn.

[73] Assignee: Eastman Kodak Company, Rochester, N.Y.

[21] Appl. No.: 284,024

[22] Filed: Jul. 17, 1981

[51] Int. Cl.[3] ..... B65H 63/02

[52] U.S. Cl. ..... 226/11; 19/0.25; 226/43; 226/45; 242/37 R

[58] Field of Search ..... 226/11, 10, 12, 24, 226/37, 42, 43, 44, 45; 242/36, 37 R, 45; 19/0.2, 0.25, 0.22; 57/78, 80, 81, 83

[56] References Cited

U.S. PATENT DOCUMENTS 3,999,695 12/1976 Bradley et al. ..... 226/11 X

*Primary Examiner*—Stanley N. Gilreath

*Attorney, Agent, or Firm*—Malcolm G. Dunn; Daniel B. Reece, III

[57] ABSTRACT

An ends-down sensor device for detecting breakage or absence of a cabinet end of filamentary yarn, involving a cylindrical roller seated upon a fixed center post with the center of gravity of the roller causing it to rotate relative to the center post in one direction and activate a suitable signal device when a cabinet end breaks or becomes missing; and upon a cabinet end frictionally engaging the cylindrical roller, causing the roller to rotate relative to the center post in the opposite direction and deactivate the signal device.

6 Claims, 6 Drawing Figures

ENDS-DOWN SENSOR DEVICE

TECHNICAL FIELD

The present invention is directed to an ends-down sensor device for detecting the breakage or absence of a cabinet end of filamentary yarn that is normally in frictional contact therewith and activating a suitable signal device upon the occurrence of such breakage or absence.

BACKGROUND OF THE INVENTION

Multi-cabinet ends in filamentary yarn processing equipment must have some means of indicating when one or more ends have dropped. In a filter tow machine, for instance, a normal tow comprises 20 cabinet ends which, when crimped and processed, make up a cigarette filter of the proper density. If a cabinet end breaks out, corrective action must be taken to continue to produce the same unit density as before. If two cabinet ends break out, an additional correction may be made or perhaps all cabinet ends may be sent to waste until the down end or ends can be reinserted in the tow band. In any event, it may be preferable to provide some signaling agency to alert the operator that a cabinet end has become broken or missing.

In the prior art, for instance, a circular rod member is used to guide a cabinet end along a predetermined path. An air orifice is provided in the surface of the circular rod member with the circular member having an air passageway therein connected at one end to said orifice and being connected at the other end to a suitable air supply. As long as a cabinet end passes over the surface of the circular rod member, the cabinet end closes off the orifice and effectively prevents any bleed-off of air therefrom. When the cabinet end breaks or is missing for some reason, the orifice is no longer blocked and the bleed-off of air therefrom occurs at a rate faster than it can pass across a flow control valve, thereby activating a pressure switch and causing a signal to occur. One disadvantage of this arrangement is that the cabinet end usually has lubricant thereon and eventually the air orifice in the circular rod member becomes plugged with lubricant and debris to such extent that no air can bleed thereform when a cabinet end breaks or is otherwise missing.

An object of the invention, therefore, is to provide an ends-down sensor device in which the air orifice is protected from becoming plugged with yarn lubricant and debris.

U.S. Pat. No. 3,999,695 (1976) discloses a rotary sensor device for detecting a running filament end when the filament is passing over a rotatable cylinder. The rotary sensor device comprises a rotatable cylinder mounted for free rotation within a housing. The housing, which is stationary, has a fluid orifice. When a running filament is in frictional engagement with the rotatable cylinder, the frictional force causes the cylinder to be rotated to a limited extent, thereby overcoming and rotating a counterweight (in a manner not completely disclosed), which is normally blocking the fluid orifice when there is no filamentary yarn frictionally engaging the rotatable cylinder. Thus when the fluid orifice becomes unblocked upon the filament's engaging and rotating the rotatable cylinder, air is then allowed to flow from the orifice. When the filament breaks, the counterweight automatically rotates back into a position blocking the fluid orifice, thereby preventing the flow of fluid out of the orifice and causing a buildup of pressure to occur in the line through which the fluid passes to the orifice. The increase in pressure is sensed, as by using a diaphragm and an electrical switch in the manner shown in the patent. The economic consequence of this operation is that air is normally flowing from the orifice when the continuous filament is running against the rotatable cylinder. The consumption of air is costly. The fluid orifice is also in a position where it can be exposed to lint, dirt and lubricant that might be thrown off.

Another object of the invention is to reduce the amount of air that may be used in the operation of the sensor device.

Still another object of the invention is to provide a structure wherein the fluid orifice is protected from exposure to lint, dirt and lubricant.

Other objects inherent in the nature of the invention disclosed will become apparent to those skilled in the art from the description which follows.

DISCLOSURE OF INVENTION

In accordance with the present invention, we provide an ends-down sensor device adapted to detect the breakage or absence of a cabinet end of filamentary yarn normally in frictional engagement with the sensor device and to activate a suitable signal device upon detecting such breakage or absence.

The sensor device has a fixed center post adapted to be positioned so that its axis lies in a horizontal plane. The center post has two flat surfaces extending along the length thereof and intersecting at a first predetermined angle to form an exterior vertex. The center post defines in the face of one of the flat surfaces an orifice from which air is adapted to flow, and defines therewithin a conduit passageway connected at one end to the orifice and at the other end to a source of air supply for the air flow and to the aforementioned suitable signal device.

A cylindrical roller is provided that has an outer cylindrical surface and interiorly two flat surfaces extending along the length of the axis thereof and intersecting at a second predetermined angle greater than the aforementioned first predetermined angle of the center post to form an interior vertex. The cylindrical roller is positioned upon the fixed center post with the interior vertex of the cylindrical roller being seated for pivotal movement upon the exterior vertex of the center post in such manner that one of the flat surfaces of the cylindrical roller is normally in abutment with one of the flat surfaces of the fixed center post while the other of the cylindrical roller flat surfaces is normally spaced away from the other of the center post flat surfaces having the orifice.

The cylindrical roller, upon frictional engagement of a cabinet end with the outer surface of the cylindrical roller, is rotated about the exterior vertex of the center post until the aforementioned other of the cylindrical roller flat surfaces is moved into abutment against the other of the center post flat surfaces, thereby closing off the orifice and stopping any significant air flow therefrom.

The interior vertex of the cylindrical roller and the exterior vertex of the center post are not coincident with the geometrical centers of the cylindrical roller and the center post.

The cylindrical roller may comprise a cylindrical sleeve and a cylindrical insert having a pie-shaped wedge removed therefrom to form the aforementioned intersecting flat surfaces of the cylindrical roller, with the cylindrical insert being secured to the inside surface of the cylindrical roller. The apex of the pie-shaped wedge preferably extends past the center of the cylindrical insert.

The cylindrical insert is oriented within the cylindrical sleeve of the cylindrical roller so that the interior vertex formed by the intersecting flat surfaces is above the axis of the center post and lies in a plane parallel to a vertical plane passing through the axis when the axis of the center post lies in the aforementioned horizontal plane and the cylindrical roller is positioned upon the center post.

The angle formed between the intersecting flat surfaces of the cylindrical roller is about 70° and the angle formed between the intersecting flat surfaces of the fixed center post is about 60°.

BRIEF DESCRIPTION OF DRAWINGS

The details of our invention will be described in connection with the accompanying drawings, in which.

BEST MODE FOR CARRYING OUT THE INVENTION

Figure 1:
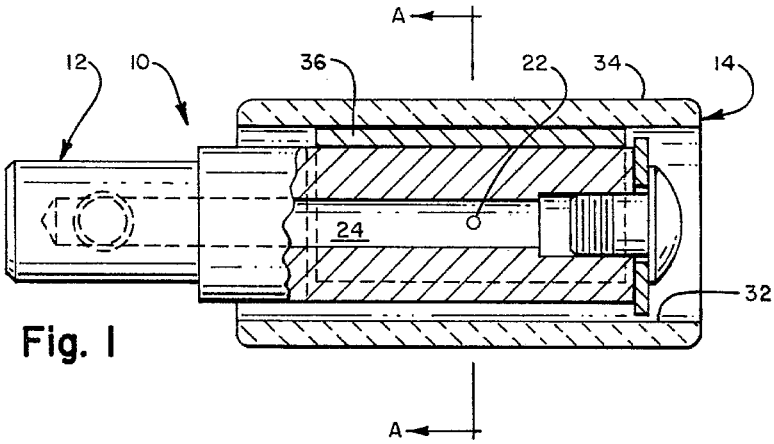
FIG. 1 is an elevational view partly in cross-section of the ends-down sensor device.
Figure 2:
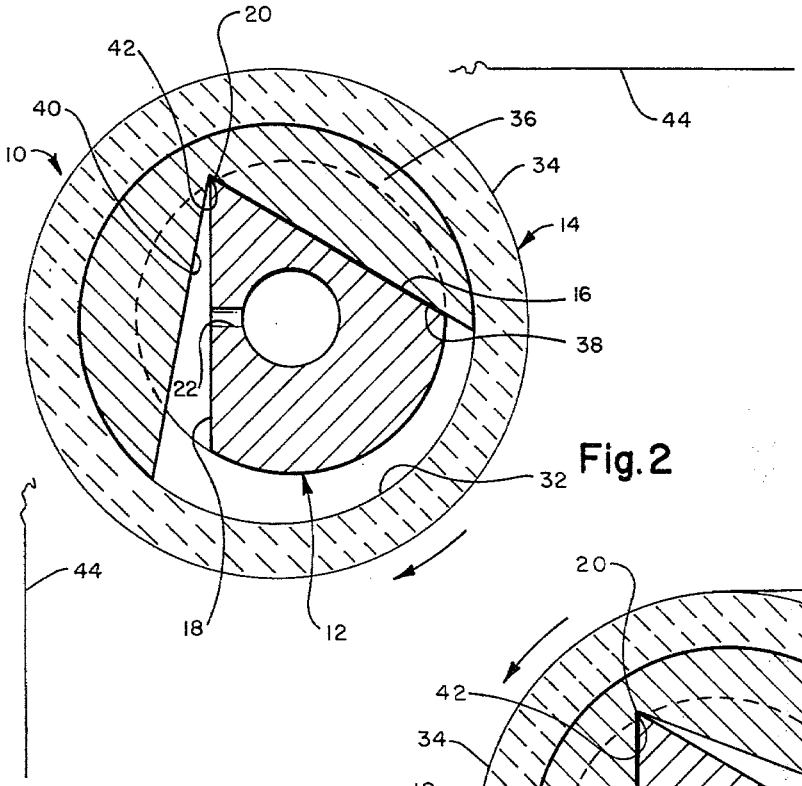
FIG. 2 is an end view in cross-section of the ends-down sensor device taken along line A—A of FIG. 1 and illustrating the position of the cyclindrical roller relative to the center post when a cabinet end is disengaged from the sensor device.

In reference to the drawings, the ends-down sensor device is shown at 10; it comprises a non-rotating or fixed center post 12 and a cylindrical roller 14.

The center post is adapted to be positioned in an operating line of a series of spinning cabinets, one for each spinning cabinet, so that its axis lies in a horizontal plane. The center post has two flat surfaces 16, 18, formed along a portion of the length of the axis and which intersect at a predetermined angle to form an exterior vertex 20. The center post defines in the face of flat surface 18 an orifice 22 from which air is adapted to flow.

Figure 4:
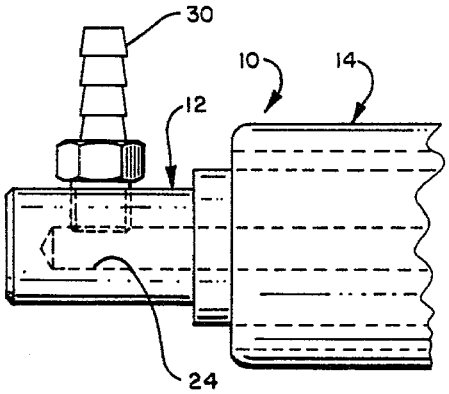
FIG. 4 is a fractional view of the ends-down sensor device, as shown in FIG. 1 but rotated 90° to illustrate the air fitting connection at one end of the center post.
Figure 6:
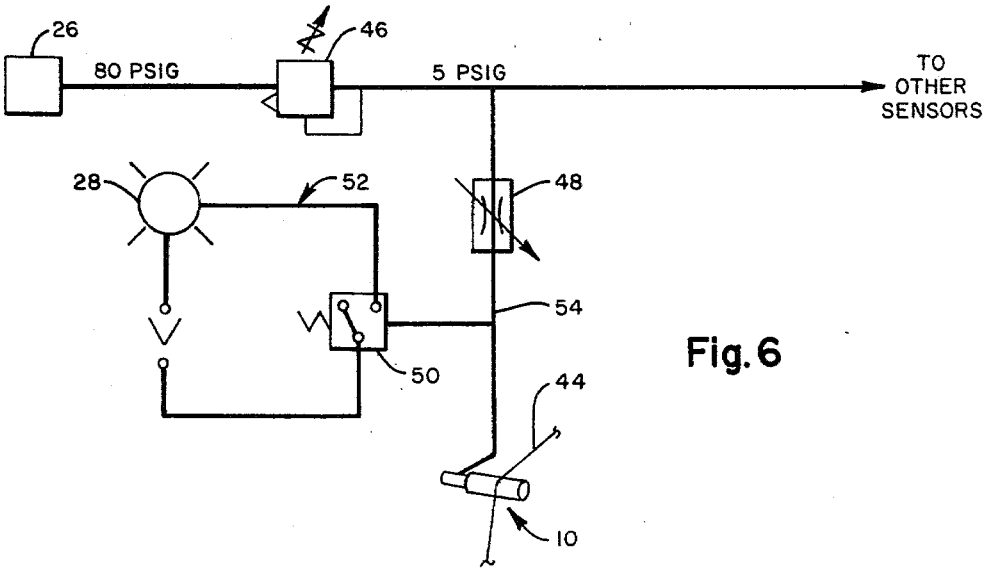
FIG. 6 is a schematic view of a typical installation involving the ends-down sensor device.

A conduit passageway 24 is provided within the center post along the axis thereof so that it is connected at one end to the orifice 22 and at the other end to a source of air supply 26 (FIG. 6) and to a suitable signal device 28 (FIG. 6). An air line may be connected to the air fitting 30, which is shown in FIG. 4.

Preferably, to facilitate construction, the cylindrical roller 14 comprises a cylindrical sleeve 32 having an outer cylindrical surface 34 which is adapted to be engaged by a cabinet end, and a cylindrical insert 36, which is suitably secured as by use of adhesive, to the interior of the cylindrical sleeve. The cylindrical insert has a pie-shaped wedge removed therefrom to form interiorly two flat surfaces 38, 40, which intersect at a predetermined angle to form an interior vertex 42. Preferably, the apex of the pie-shaped wedge extends past the geometrical center of the cylindrical insert in the manner illustrated. The cylindrical insert 36 is thus oriented within the cylindrical sleeve 32 so that the interior vertex 42 formed by the intersecting flat surfaces 38, 40, is above the axis of the center post 12 and lies in a plane parallel to a vertical plane passing through the axis of the center post, when the center post axis lies in the horizontal plane in which the center post is designed to be installed and the cylindrical roller 14 is positioned upon the center post.

The cylindrical roller may, of course, be made in one piece, if desired, rather than in two sepatare parts.

The cylindrical roller 14 is positioned upon the fixed center post 12 with the interior vertex of the cylindrical roller being seated for pivotal movement upon the exterior vertex of the fixed center post in such manner that the flat surface 38 of the cylindrical roller is normally in abutment with flat surface 16 of the center post while flat surface 40 is normally spaced away from the flat surface 18 of the center post in which orifice 22 is located.

Figure 3:
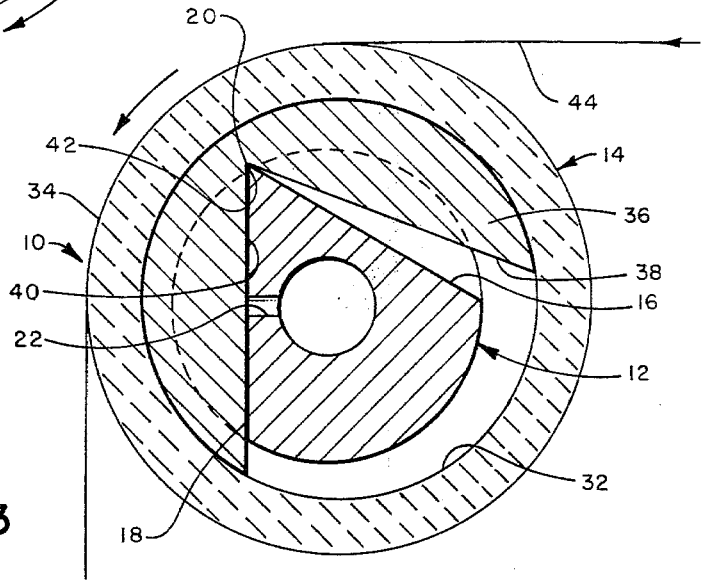
FIG. 3 is an end view in cross-section of the ends-down sensor device taken along line A—A of FIG. 1 and illustrating the position of the cylindrical roller relative to the center post when a cabinet end is engaged with the sensor device.

When cabinet end 44 is frictionally engaged with the outer surface 34 of the cylindrical roller (FIG. 3), the cylindrical roller 14 is thereby caused to rotate about the exterior vertex of the center post until the other of the cylindrical roller flat surfaces, flat surface 40, is moved into abutment against the other of the center post flat surfaces, flat surface 18, thereby closing off the orifice 22 and stopping any significant air flow therefrom.

As heretofore mentioned, the interior vertex 42 of the cylindrical roller and the exterior vertex 20 of the center post are not coincident with the geometrical centers of the cylindrical roller and center post.

The angle between the intersecting flat surfaces 38, 40, is preferably about 70°, and the angle between the intersecting flat surfaces 16, 18, of the fixed center post is preferably about 60°.

Figure 5:
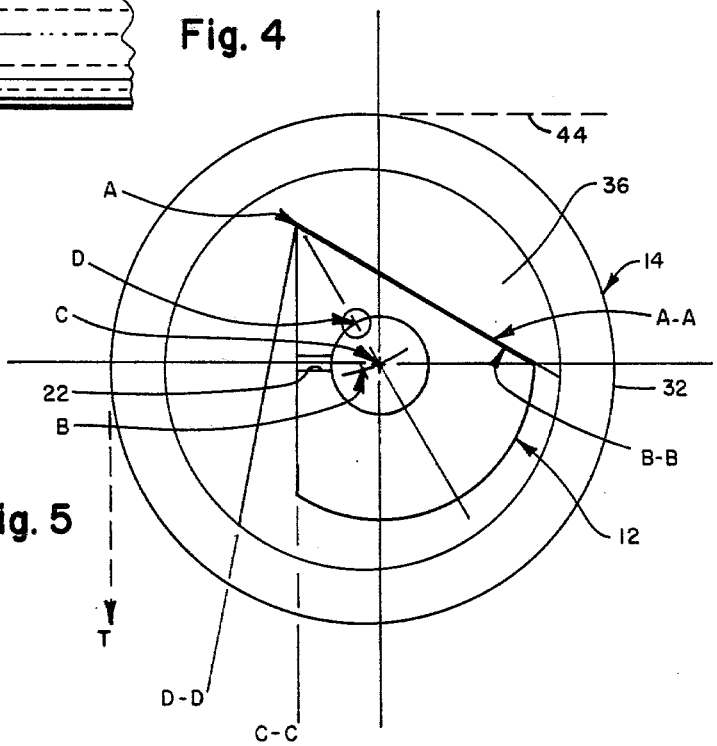
FIG. 5 is an operating diagram of the cylindrical roller relative to the center post illustrating the normal reaction of the sensor device to yarn and gravity forces.

In reference to the operating diagram in FIG. 5:

Point A is the center of rotation of element 32;

Point B is the center of gravity of element 32;

Point c is the center of element 12;

Point D is the center of gravity of element 36; and

T represents the torque exerted by cabinet end 44.

When a cabinet end is not in frictional engagement with the cylindrical roller 14, if one sums the moments around the center of rotation, Point A, then:

(a) The cylindrical sleeve 32 produces a clockwise rotation since its center of gravity is to the right of Point A (b) The cylindrical insert 36 also produces a clockwise rotation since its center of gravity is also to the right of Point A;

thus the normal condition is such that surface AA rests on or is supported by surface BB.

When a cabinet end 44 is in frictional engagement with the cylindrical roller 14, (c) the cabinet end friction on cylindrical sleeve 32 produces a counterclockwise torque;

(d) the resultant cabinet end force acts to the left of the center of rotation, Point A, thereby producing a counterclockwise torque, The torque produced by (c) and (d) is greater than that which produces the gravitational clockwise torque. Therefore, the cylindrical sleeve 32 and the cylindrical insert 36 are rotated, causing surface DD to come to rest on surface CC, thereby covering the orifice 22.

OPERATION

In reference to the drawings, and particularly to FIG. 6, a regulated air pressure and flow is supplied to the ends-down sensor device 10 from the source of air supply 26, passing through a pressure regulator 46 so that a pressure of about 5 psig passes to the ends-down sensor device through the flow control valve 48. When a cabinet end breaks or becomes missing for whatever reason, the center of gravity of the cylindrical roller 14 causes the cylindrical roller to rotate above the exterior vertex 20 to such extent that the orifice 22 becomes uncovered. Air then escapes from the orifice at a rate faster than it can pass across the flow control valve 48, thus causing a loss of air pressure to the pressure switch 50. The pressure switch then reverts to its normally closed position, thereby completing the electrical circuit 52 and activating the signal device 28. As soon as a cabinet end is caused to re-engage the outer cylindrical surface 34 of the cylindrical roller, the resultant cabinet end force and torque causes the cylindrical roller to rotate relative to the fixed center post 12 in the manner previously described until the orifice 22 again becomes covered, thus stopping the flow of air from the orifice. Air pressure then builds up in the air line 54 until the pressure switch 50 is deactivated, thereby breaking the electrical circuit and de-energizing the signal device 54.

As shown in FIG. 6, the air line 54 may lead also to other ends-down sensor devices.

The invention has been described in detail with particular reference to preferred embodiments thereof, but it will be understood that variations and modifications can be effected within the spirit and scope of the invention.

We claim:

1. An ends-down sensor device adapted to detect the breakage or absence of a cabinet end of filamentary yarn normally in frictional engagement with said sensor device and to activate a suitable signal device upon detecting such breakage or absence, said sensor device comprising:

a fixed center post adapted to be positioned so that its axis lies in a horizontal plane and having two flat surfaces extending along the length thereof and intersecting at a first predetermined angle to form an exterior vertex, said center post defining in the face of one of said flat surfaces an orifice from which air is adapted to flow, and defining therewithin a conduit passageway connected at one end to said orifice and at the other end to a source of air supply for said air flow and to said suitable signal device, and;

a cylindrical roller having an outer cylindrical surface and interiorly two flat surfaces extending along the length of the axis thereof and intersecting at a second predetermined angle greater than said first predetermined angle to form an interior vertex, said cylindrical roller being positioned upon said fixed center post with the interior vertex of said cylindrical roller being seated for pivotal movement upon the exterior vertex of said fixed center post in such manner that one of the flat surfaces of said cylindrical roller is normally in abutment with one of the flat surfaces of said fixed center post while the other of said cylindrical roller flat surfaces is normally spaced away from the other of said center post flat surfaces having said orifice;

said cylindrical roller, upon frictional engagement of a cabinet end with the outer surface of said cylindrical roller, being rotated about the exterior vertex of said center post until said other of said cylindrical roller flat surfaces is moved into abutment against said other of said center post flat surfaces, thereby closing off said orifice and stopping any significant air flow therefrom.

2. An ends-down sensor device as defined in claim 1 wherein said interior vertex of the cylindrical roller and said exterior vertex of the center post are not coincident with the geometric centers of said cylindrical roller and said center post.

3. An ends-down sensor device as defined in claim 1 wherein said cylindrical roller comprises a cylindrical sleeve and a cylindrical insert having a pie-shaped wedge removed therefrom to form said intersecting flat surfaces of said cylindrical roller, said cylindrical insert being secured to the inside surface of said cylindrical sleeve.

4. An ends-down sensor device as defined in claim 3 wherein the apex of said pie-shaped wedge extends past the center of said cylindrical insert.

5. An ends-down sensor device as defined in claim 3 wherein said cylindrical insert is oriented within said cylindrical sleeve so that the interior vertex formed by said intersecting flat surfaces is above the axis of said center post and lies in a plane parallel to a vertical plane passing through said axis when said axis of the center post lies in said horizontal plane and said cylindrical roller is positioned upon said center post.

6. An ends-down sensor device as defined in claim 1 wherein the angle between the intersecting flat surfaces of said cylindrical roller is about 70° and the angle between the intersecting flat surfaces of said fixed center post is about 60°.

* * * * *